US005854619A

United States Patent [19]

Kato

[11] Patent Number: 5,854,619

[45] Date of Patent: Dec. 29, 1998

[54] KARAOKE APPARATUS DISPLAYING IMAGE SYNCHRONOUSLY WITH ORCHESTRA ACCOMPANIMENT

[75] Inventor: Hirokazu Kato, Hamamatsu, Japan

[73] Assignee: Yamaha Corporation, Hamamatsu, Japan

[21] Appl. No.: 496,978

[22] Filed: Jun. 29, 1995

Related U.S. Application Data

[63] Continuation of Ser. No. 132,581, Oct. 6, 1993, abandoned.

[30] Foreign Application Priority Data

Oct. 9, 1992 [JP] Japan ..... 5-297793

[51] Int. Cl.[6] ..... G09G 5/40; G10H 1/36

[52] U.S. Cl. ..... 345/116; 84/610; 84/645

[58] Field of Search ..... 345/116, 122, 345/115; 358/335, 342; 84/609, 610, 611, 612, 634, 635, 636

[56] References Cited

U.S. PATENT DOCUMENTS

| | | | |
|---|---|---|---|
| 5,046,004 | 9/1991 | Tsumura et al. | 84/645 |
| 5,208,413 | 5/1993 | Tsumura et al. | 84/615 |
| 5,247,126 | 9/1993 | Okamura et al. | 84/609 |
| 5,250,747 | 10/1993 | Tsumura et al. | 84/645 |
| 5,286,907 | 2/1994 | Okamura et al. | 84/610 |
| 5,410,097 | 4/1995 | Kato et al. | 84/610 |
| 5,484,291 | 1/1996 | Nakai et al. | 84/610 |

FOREIGN PATENT DOCUMENTS

| | | |
|---|---|---|
| 3116474 | 5/1991 | Japan . |
| 043386 | 1/1992 | Japan . |
| 4190397 | 7/1992 | Japan . |
| 81102076 | 2/1993 | Taiwan . |

OTHER PUBLICATIONS

"Interface of Videotex Communication Network Service (Terminal)", Aug. 25, 1994, published by the Electric Communication Society (Japan).

*Primary Examiner*—Amare Mengistu
*Attorney, Agent, or Firm*—Graham & James LLP

[57] ABSTRACT

A Karaoke apparatus reproduces an instrumental accompaniment of a song requested by a singer during the course of a vocal performance of the song by the singer. A memory is provided for registering a composite text data of a song containing accompaniment information, word information and picture information in linked manner with each other. A sound system receives the accompaniment information for reproducing an instrument accompaniment of said song according to the accompaniment information. A display system receives the word information and the picture information for displaying a word of said song in the form of a sequence of characters according to the word information, and for displaying, in superposed relation to the word, an image associated to said song according to the picture information. A controller addresses the memory to sequentially distribute the accompaniment information, the word information and the picture information in synchronous manner with each other to those of the sound system and the display system so that the word and the image can be displayed in linked manner to progression of the sounded instrumental accompaniment.

6 Claims, 8 Drawing Sheets

KARAOKE APPARATUS DISPLAYING IMAGE SYNCHRONOUSLY WITH ORCHESTRA ACCOMPANIMENT

This is a continuation of application Ser. No. 08/132,581 filed on Oct. 6, 1993 is now abandoned.

BACKGROUND OF THE INVENTION

The present invention relates to a Karaoke apparatus and more particularly to those provided with a tone generator in the forth of a musical sound synthesizer operative according to registered accompaniment information to automatically sound an instrumental accompaniment or "empty orchestra" ("Karaoke" in Japanese) accompaniment during at physical vocal performance of a requested song by a singer.

Recently, the karaoke apparatus is widely popularized. The Karaoke apparatus is equipped with an audio medium such as a magnetic tape or an optical disc for recording an instrumental accompaniment part of a popular song except for a vocal performance part. The singer physically performs the vocal part while the instrumental accompaniment part is being reproduced. The Karaoke apparatus is installed with a mixer which mixes a physical singing voice picked lip by a microphone wit the Karaoke accompaniment together with a reverberation effect or else, thereby enjoying an interesting song performance. Further, one type of the Karaoke apparatus utilizes a video medium such as an optical disc for displaying word information of the song as well as associated image information, in addition to the audio reproduction of the instrumental accompaniment. Such a Karaoke apparatus is more and more sophisticated in various aspects such as structure of the installed tone generator, manner by which word information is provided, and arrangement of peripheral equipments under divergent environment in amusement of the Karaoke performance.

Another type of the Karaoke apparatus is installed with a sophisticated tone generator, i.e., a musical sound synthesizer which is generally adopted in an electronic musical instrument or a computer music box. While the tone generator is driven according to registered accompaniment information of the instrumental accompaniment, a display device is driven concurrently according to registered word information to visually indicate song words in the form of a sequence of characters in synchronization with the automatic instrumental accompaniment. This Karaoke apparatus utilizes simplified accompaniment information like a text data of a musical score, rather than audio information based on sampled analog waves, thereby saving a data amount and facilitating transfer and copy of the registered accompaniment information.

The conventional Karaoke apparatus may be equipped with an optical disc unit for displaying image information during the course of the instrumental accompaniment. In such a case, word information is prepared together with the accompaniment information in the form of a song data, so that the word information can be displayed in superposed manner with the image information reproduced from an optical disc. However, in the conventional Karaoke apparatus, the displaying of the image in-formation is simply commenced at the start of the reproduction of the orchestra accompaniment, and is simply terminated at the end of the orchestra accompaniment. Therefore, the image information could not, be closely associated with or synchronized to the progression of the orchestra accompaniment.

SUMMARY OF THE INVENTION

In view of the above noted drawbacks of the conventional Karaoke apparatus, an object of the invention is to provide an improved Karaoke apparatus which can display image information in synchronous manner to progression of orchestra accompaniment while enabling variable control of the progression in the orchestra accompaniment. According to the invention, the Karaoke apparatus for reproducing an instrumental accompaniment of a requested song during the course of a vocal performance of the song by a singer, includes register means for registering a composite data of a song containing accompaniment information, word information and picture information in linked manner with each other, sound means receptive of the accompaniment information for reproducing an instrumental accompaniment, of said song according to the accompaniment information, display means receptive of the word information and the picture information for displaying a word of said song in the form of a sequence of characters according to the word information, and for displaying, in superposed relation to the word, an image associated to said song according to the picture information, and control means for addressing the register means to sequentially distribute the accompaniment information, the word information and the picture information in synchronous manner with each other to those of the sound means and the display means so that the word and the image can be displayed in linked manner with progression of the sounded instrumental accompaniment.

In a preferred form, the control means includes skip means responsive to a given skip command for skipping distribution of the accompaniment information, the word information and the picture information concurrently with each other so that the displayed word and image can be skipped synchronously to skip of the sounded instrumental accompaniment. In another preferred form, the control means includes repeat means responsive to a given repeat command for repeating distribution of the accompaniment information, the word information and the picture information concurrently with each other so that the displayed word and image can be repeated synchronously to repeat of the sounded instrumental accompaniment.

DETAILED DESCRIPTION OF THE INVENTION

Figure 1:
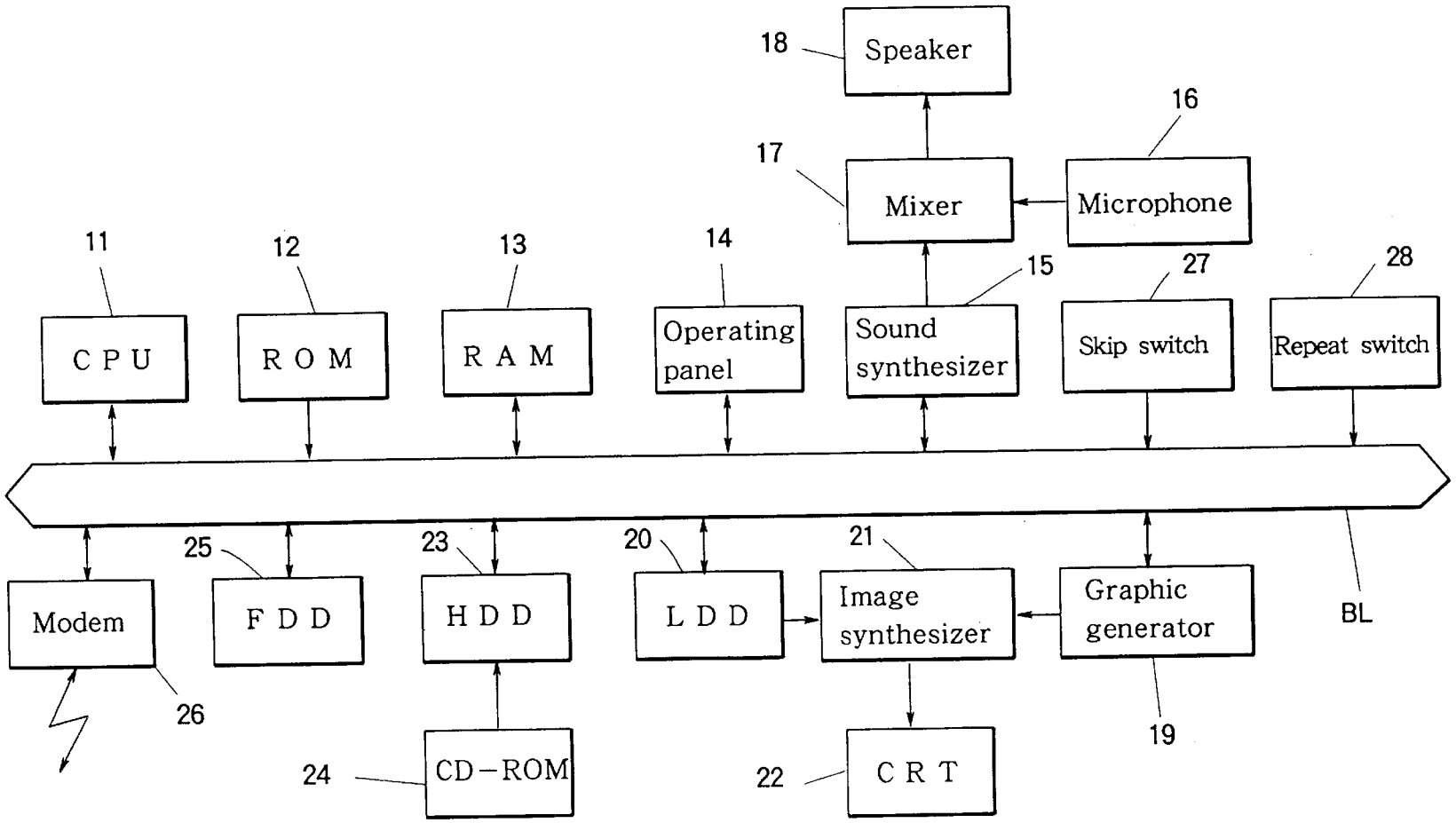
FIG. 1 is a schematic block diagram showing a first embodiment of the inventive Karaoke apparatus.

Hereinafter, preferred embodiments of the invention will be described in conjunction with the drawings. FIG. 1 schematically shows a first embodiment of the inventive Karaoke apparatus. The inventive Karaoke apparatus is installed with a sound synthesizer operated according to simplified performance information, i.e., a song text data similar to a musical score so that the Karaoke apparatus can flexibly process the song text data to freely control or alter or modify progression scheme of the orchestra accompaniment to thereby realize various unusual operations such as skip operation and repeat operation. In this embodiment, the song text data contains a pair of parallel tracks for respective ones of accompaniment information and picture information so as to link displaying of an image and sounding of an orchestra accompaniment with one another, while allowing irregular progression of Karaoke performance.

The Karaoke apparatus of FIG. 1 is comprised of a central processing unit (CPU) 11, a read-only memory (ROM) 12, a random access memory (RAM) 13, an operating panel 14, a musical sound synthesizer 15, a microphone 16, a mixer 17, a speaker 18, a graphic generator 19 in the form of a computer graphic unit, a laser disc unit (LDD) 20, an image synthesizer 21, a display unit 22 such as a CRT, a hard disc unit (HDD) 23, a compact disc ROM unit (CD-ROM) 24, a floppy disc unit (FDD) 25, a modem 26, a skip switch 27 and a repeat switch 28. The LDD 20 can deal with various optical discs such as Laser Disc (trademark) and other medium recorded with CD Graphics or digital motion picture. Otherwise, a video cassette tape deck may be used in place of the LDD 20 though an access time may cause some difficulty. In this embodiment, the modem 26 is utilized for an interface of a communication network. A common bus line BL is provided to connect altogether those of CPU 11, ROM 12, RAM 13, operating panel 14, musical sound synthesizer 15, graphic generator 19, LDD 20, HDD 23, FDD 25, modem 26, skip switch 27 and repeat switch 28.

The CPU 11 controls and manages entire operation of the Karaoke apparatus. The ROM 12 is written with an operation program including a performance control program which is used for reproducing orchestra accompaniment, and which contains a specific program for effecting unusual operation such as skip or repeat operation. The skip operation is commenced in response to a given command such that a certain block of the song is skipped irregularly during the continuous progression of the orchestra accompaniment. The repeat operation is commenced also in response to a given command such that a particular block is repeated intentionally during the straight progression of the orchestra accompaniment. With regard to the skip operation, the block is defined in terms of a relatively long period such as a chorus, a verse, a refrain and a bridge. With regard to the repeat operation, the block is defined in terms of a relatively short period such as a measure or a phrase which contains several measures.

The RAM 13 is used when the CPU 11 controls and manages the operation of the Karaoke apparatus. The operation program stored in the ROM 12 is loaded into the RAM 13 by the control of the CPU 11 when the Karaoke apparatus is turned on. The operating panel 14 contains various manual pieces such as switches and knobs for operating the Karaoke apparatus.

The musical sound synthesizer 15 is driven according to accompaniment information to generate a musical sound signal of the instrumental accompaniment part. The synthesizer 15 is provided with a tone generator such as an MIDI tone generator and a controller for controlling the tone generator. The microphone 16 is used for picking up a voice of the performer who is singing accompanied by the Karaoke apparatus. The mixer 17 mixes an output of the musical sound synthesizer 15 and another output of the microphone 16 with each other. The mixer 17 is provided with an echo device or reverberation device, if desired, for adding reverberation effect to the output of the microphone 16. The speaker 18 is driven by an output of the mixer 17 to sound a complete song performance which is the mixture of the instrumental accompaniment part from the musical sound synthesizer 15 and the physical vocal part from the microphone 16.

The graphic generator 19 processes word information representative of words of a requested song and direct picture information representative of a still image or a moving image, those of which are registered together with the accompaniment information, to thereby generate a graphic signal for the display unit 22. The LDD 20 is actuated when the performer requests a particular song which is specified to use image information recorded in an installed laser disc. The LDD 20 is accessed according to indirect picture information in synchronization with the accompaniment information to reproduce image information such as a given still image of a specified frame in a specified laser disc or a given moving image which starts from a specified frame in a specified laser disc. For this, the LDD 20 is preferably provided with auto-selecting function of plural laser discs. The image synthesizer 21 combines an output of the graphic generator 19 and another output of the LDD 20 with one another to synthesize a composite image signal. The display unit 22 such as CRT visually reproduces the composite image formed by the image synthesizer 21.

The hard disc unit 23 is stored with a text data of each Karaoke song, such as a song name, a singer name, a release date, key words, accompaniment information, picture information, measure information, and word information. The operating panel 14 is actuated to select a requested song. The CPU 11 operates to load the text data of the selected song into the RAM 13. Then, the RAM 13 is addressed by the CPU 11 to read out the loaded or registered text data including the accompaniment information and the picture information, which are separately fed to the musical sound synthesizer 15 and to the graphic generator 19, thereby effecting a Karaoke performance of multi-media. The CD-ROM unit 24 is utilized to read out a source text data of each song stored in a memory medium of a CD-ROM to down-load the same into the hard disc unit 23.

The floppy disc unit 25 is provided for recording and reproduction of the text data such as to write a certain text data of the hard disc unit 23 into a floppy disc, or such as to read out a text data from a floppy disc to down-load the same into the hard disc unit 23. The floppy disc is utilized to transfer the text data among Karaoke apparatuses. The modem 26 is utilized to connect one Karaoke apparatus to another Karaoke apparatus or to a host system through a communication channel such as to transmit and receive a text data or other performance data.

Figure 2:
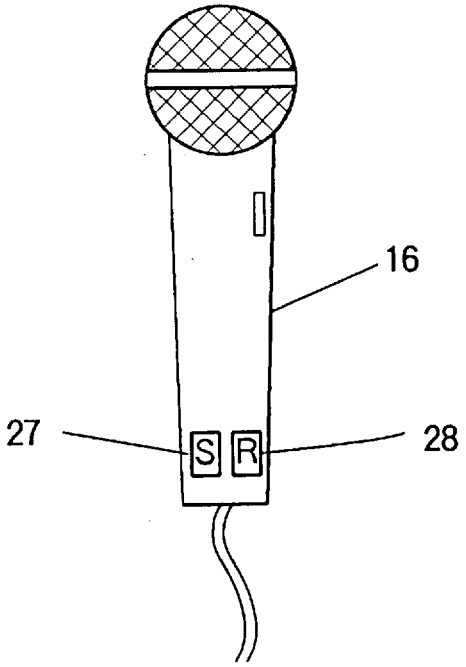
FIG. 2 is a side view of a microphone utilized in the FIG. 1 embodiment, and provided with a pair of skip switch and repeat switch.

The skip switch 27 is manually operated to input a skip command. The repeat switch 28 is also manually operated to input a repeat command. As shown in FIG. 2, for example, these skip and repeat switches 27, 28 are disposed on a grip of the microphone 16 separately from the main operating panel for facilitating input operation by the singer during the song performance.

In the Karaoke apparatus shown in FIG. 1, the CD-ROM unit 24 is operated to provisionally down-load a text data from a CD-ROM into the hard disc unit 23, while the LDD 20 is set with an optical disc if necessary. Alternatively, the text data down-loaded in the hard disc unit 23 is initially provided from a floppy disc by means of the floppy disc unit 25, or fed from the communication channel through the modem 26.

In operation of the Karaoke apparatus shown in FIG. 1, when a power source is turned on, the operation program written in the ROM 12 is loaded into the RAM 13 to initiate the operation. The operating panel 14 is actuated so that the CPU 11 commences according to the operation program in the RAM 13, various performances such as an automatic accompaniment. The above mentioned down-loading into the hard disc unit 23 is also initiated by the actuation of the operating panel 14 upon the turn-on of a power source under the control by the CPU 11. Then, the operating panel 14 is actuated to select a desired song so that a text data of the selected song is retrieved from the hard disc unit 23, and is loaded and registered into the RAM 13. The Karaoke performance is commenced according to the retrieved text data. During the course of the Karaoke performance, the musical sound synthesizer 15 sequentially generates according to the accompaniment information contained in the song text data a musical tone signal, which is sounded by the speaker 18 through the mixer 17. Meanwhile, the graphic generator 19 operates according to the word information and the measure information contained in the song text data to generate a sequence of characters representative of the song words updated each measure with progression of the song performance. The characters are displayed on the display unit 22 by means of the image synthesizer 21.

In this operation, a sequence of the displayed characters representative of the song words are successively turned to a different color with the progression of the song performance according to color information contained in the song text data, thereby teaching the performer a successive voice timing of the displayed characters. Moreover, the graphic generator 19 operates according to direct picture information contained in the text data to generate a graphic image with the progression of the song performance. The display unit 22 is driven by the image synthesizer 21 to display the graphic image in superposed relation to the characters of the song words. Optionally in case that a selected song specifies the use of an optical disc, a particular one is selected at the start of the song performance so that a designated section of the selected optical disc is reproduced according to indirect picture information contained in the text data. A reproduced image is displayed on the display unit 22 by means of the image synthesizer 21. Consequently, the performer can manage his own vocal timings according to the words visually indicated on the display unit 22.

Next, the description is given for the skip and repeat operations of the orchestra accompaniment.

Figure 3:
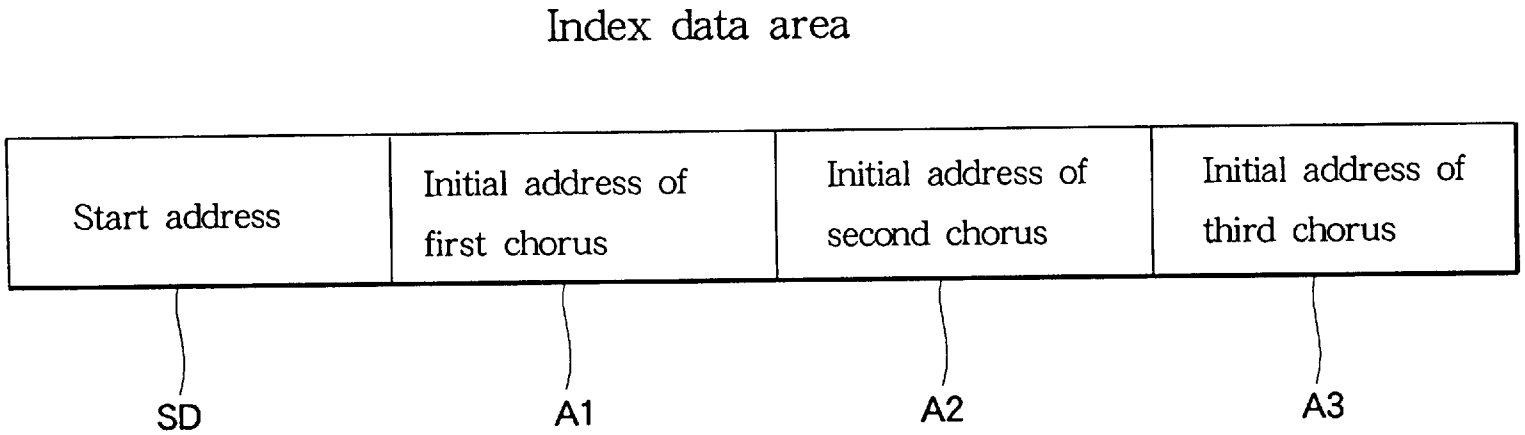
FIG. 3 is a format diagram illustrating an index data area contained in a song text data registered in the FIG. 1 embodiment.

In this embodiment, an index data area is provided at a top of the text data format of each song which is transferred to the RAM 13 from the hard disc unit 23, and which is retrieved sequentially from the RAM 13 to effect performance. As shown in FIG. 3, in case that the selected song is composed of first, second and third choruses, the index data area is recorded with those of a start address data SD indicative of a start address of the song text data, a first initial address data A1 of the first chorus, a second initial address data A2 of the second chorus, and a third initial address data A3 of the third chorus. The index data area is followed by a performance data area, which is a main part of the song text data.

Figure 4:
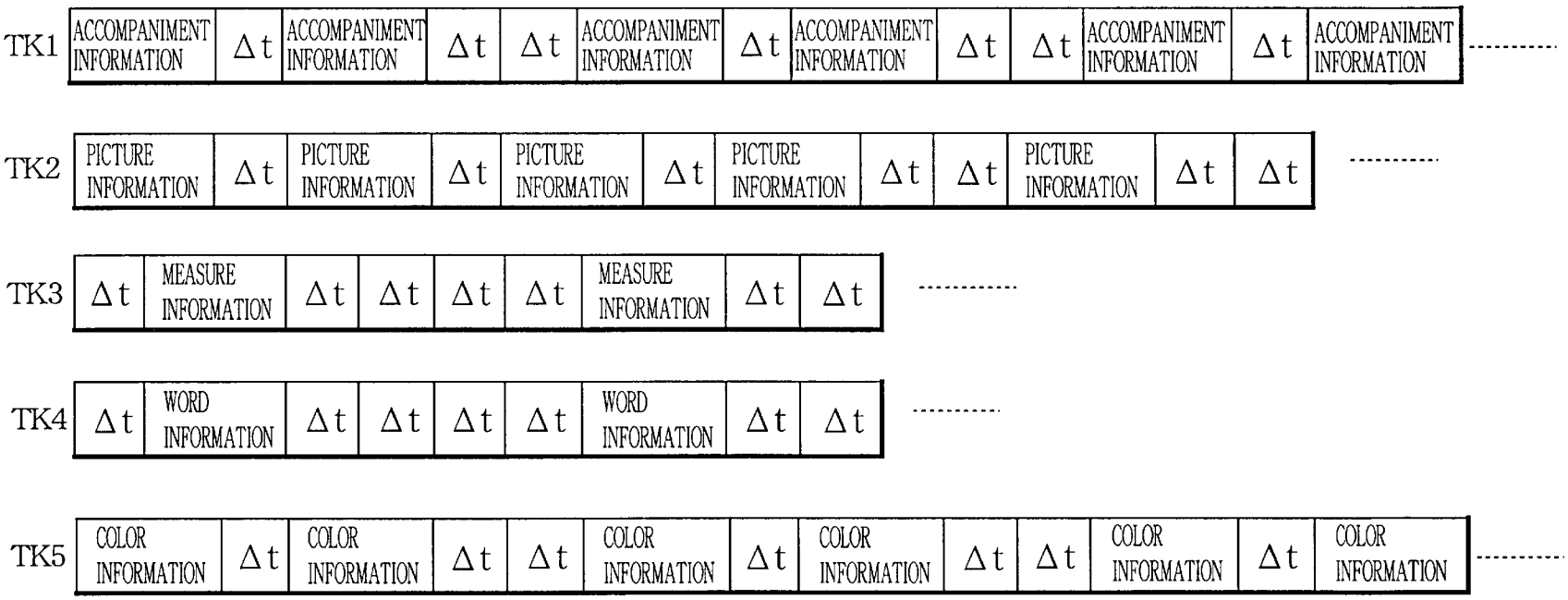
FIG. 4 is a format diagram illustrating a performance data area which is a main part of the song text data.

The performance data is registered in a given format as shown in FIG. 4. Namely, the performance data is recorded in a plurality of parallel tracks TK1, TK2, TK3, TK4 and TK5. The first track TK1 is assigned with accompaniment information, which is provided for driving the sound synthesizer 15 to generate an accompaniment tone signal. The second track TK2 is assigned with picture information which is provided for driving the graphic generator 19 to generate a graphic image signal, and/or for driving the LDD 20 to designate an image to be reproduced from an optical disc. The third track TK3 is assigned with measure information (containing an order of bars involved in a score of the song. The fourth track TK4 is assigned with word information which is provided for driving the graphic generator 19 to generate a character signal effective to visually indicate the song words. Lastly, the fifth track TK5 is assigned with color information effective to change color of displayed characters with the progression of the orchestra accompaniment.

If the second track TK2 contains direct picture information, the graphic generator 19 generates a graphic image signal composed of the image signal according to the direct picture information and the character signal according to the word information. The image synthesizer 21 operates to synthesize for the display unit 22 a composite image signal composed of the graphic image signal containing at least the character signal generated by the graphic generator 19, and the pure image signal produced by the LDD 20.

Those of the various information are composed of a sequence of an event and a time interval $\Delta T$. The event represents one tone in the accompaniment information, one frame in the picture information, one bar in the measure information, and one phrase in the word information. The time interval $\Delta t$ indicates a time length between adjacent events. For example, with regard to the track TK1 of the accompaniment information, an on-event is followed by an off-event while an interval $\Delta t$ is interposed so that one tone is generated during a duration determined by the time interval $\Delta t$ between the on-event arid the off-event. Though the accompaniment information is illustratively written in a single of the first track TK1, practically the track TK1 is divided into a plurality of subtracks corresponding to different instruments involved in the orchestra accompaniment. Further, timbre information of each instrument may be included in the accompaniment information. In the FIG. 4 format, the interval is set in terms of a minimum time unit $\Delta t$ such that a desired interval length is set as a multiple of the minimum time units. Alternatively, each time interval may be set variably.

Figure 5:
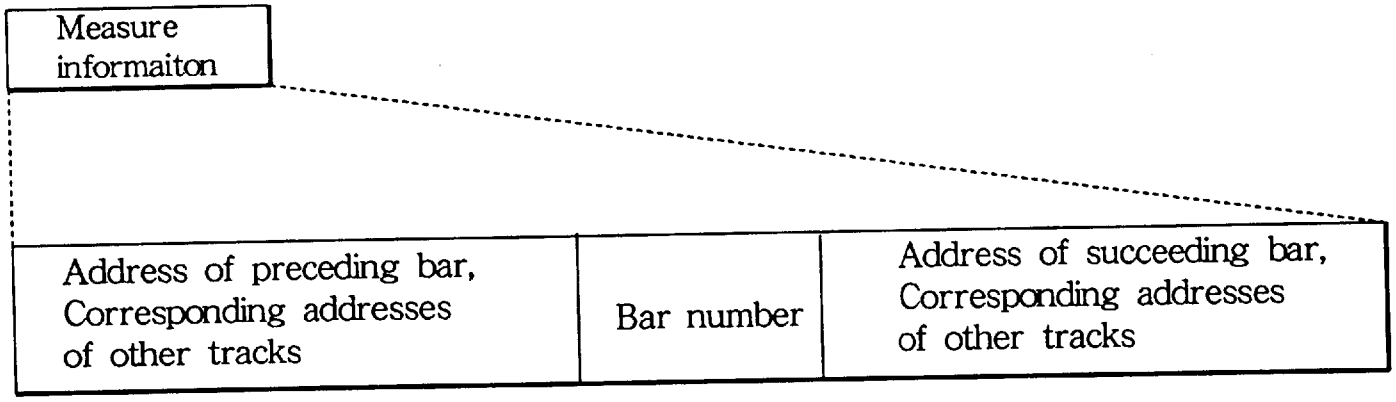
FIG. 5 is a detailed format diagram illustrating contents of measure information included in the performance data.

Further, as shown in FIG. 5, the measure information has a detailed data format containing a measure bar number as well as all address of an immediately preceding bar and corresponding address data of the remaining parallel tracks, and another address of all immediately succeeding bar and corresponding address data of the remaining parallel tracks.

When the skip switch 27 is actuated, the current block which may be a certain chorus part is terminated at the end thereof, and then the Karaoke accompaniment jumps to a second next block to continue the Karaoke accompaniment while skipping all immediately next block. In this skip operation, since the picture information is linked to the accompaniment information, the displayed image is also skipped synchronously with the sounded accompaniment so that the displayed image is automatically changed to match with the orchestra accompaniment. Consequently, the image displaying and the accompaniment sounding can be terminated concurrently with each other at the end of the song performance.

For instance, in case that the performed song is composed of three choruses, when the skip switch 27 is actuated just before the start of the song performance, the Karaoke accompaniment is started from the second chorus. When the skip switch 27 is actuated in the middle of the first chorus, the Karaoke accompaniment jumps to the third chorus after the first chorus is ended. Further, when the skip switch 27 is actuated in the middle of the second chorus, the Karaoke accompaniment returns to the first chorus after the second chorus is ended. In such a skip operation, each block is separated by a measure bar in manner similar to general accompaniment refrain or tonality transposition, thereby maintaining continuous performance in natural manner.

On the other hand, if the repeat switch 28 is actuated, the orchestra accompaniment does not advance to a next block, e.g., a next measure after the current block is ended, but the same current block is repeated. In this repeat operation, since the picture information is linked to the accompaniment information, the displayed image is repeated synchronously with the repeat of the orchestra accompaniment. Therefore, there is no discrepancy between the displaying of the image and the sounding of the accompaniment at the end of the song performance. The repeat block is also divided by a measure bar in similar manner to general accompaniment refrain or tonality transposition, thereby ensuring natural repeat operation which may be useful for practice of a hard song.

Next, the detailed description of the skip operation will be given with reference to a flowchart of FIG. 6. When the operating panel 14 is actuated to select a desired song, a text data of the selected song is loaded and registered into the RAM 13 from the hard disc unit 23. At first in Step S11, every part of the Karaoke system is initialized so that a skip flag SF is also reset to "0". Then, Step S12 is undertaken to commence various processings including concurrent reproduction of the accompaniment and the image according to the text data sequentially retrieved from the RAM 13. Next, Step S13 is undertaken to check as to if the skip switch 27 is actuated. If the check result shows YES, Step S14 is called to set the skip flag SF to "1". On the other hand, if the skip switch 27 is not actuated, the processing advances to Step S15 while the skip flag SF is maintained "0". In Step S15, check is made as to if a current block reaches an end. If the current block is ended, Step S16 is undertaken to check as to whether SF="1". In case that SF="1" is held, Step S17 is executed to skip an immediately next block to thereby continue to a second next block. Lastly, Step S18 is undertaken to check as to if the orchestra accompaniment reaches at last end. If the check result is NO, the processing returns to Step S12 to continue the processings until the last end of the orchestra accompaniment. On the other hand, if either of the check result of Steps S15 and S16 is held negative, the processing proceeds to Step S18. Then, when the check result of Step S18 indicates the last end, the orchestra accompaniment is terminated.

Figure 7:
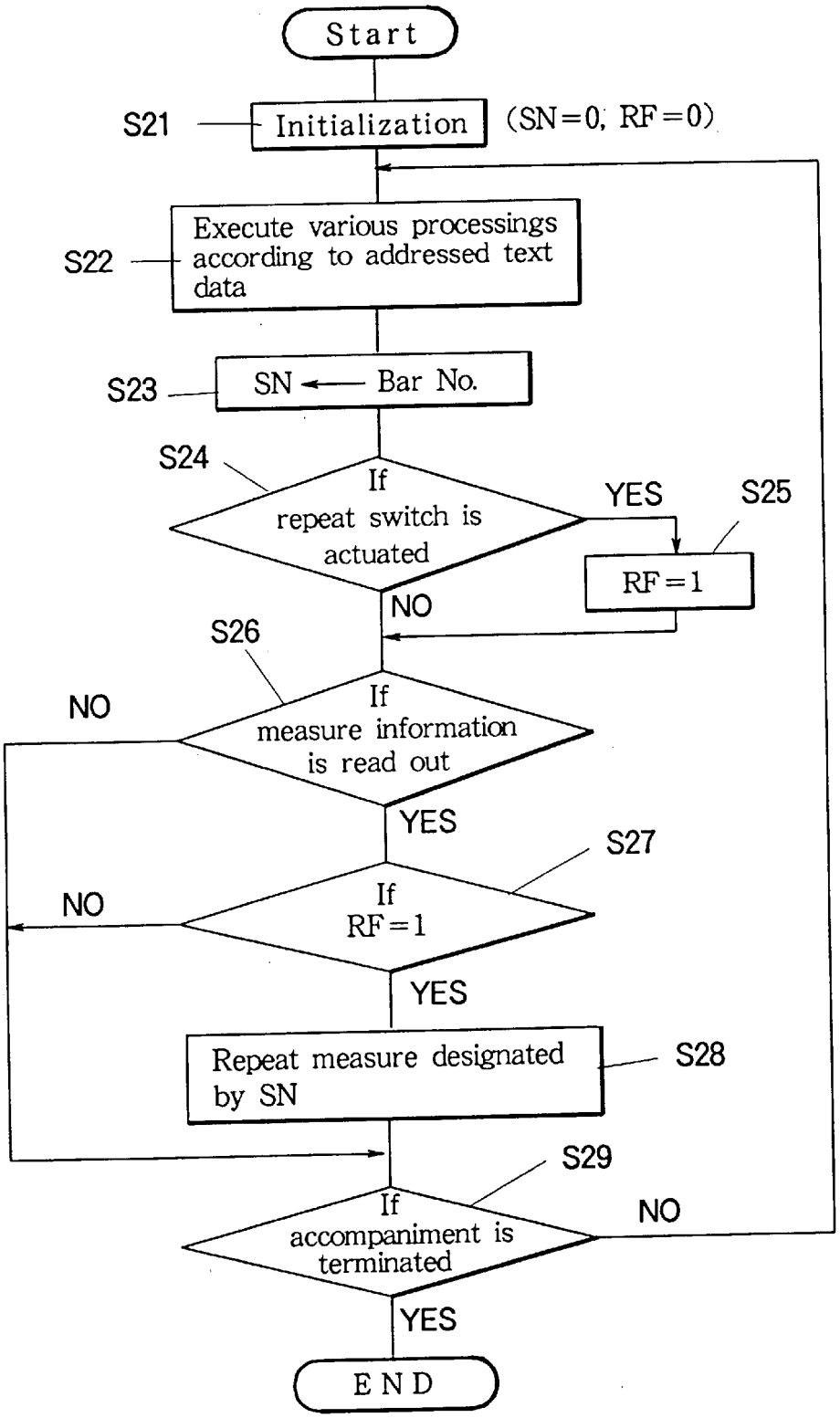
FIG. 7 is a flowchart showing repeat operation in the FIG. 1 embodiment.

Next, the detailed description is given for the repeat operation with reference to a flowchart of FIG. 7. When the operating panel 14 is actuated to select a desired song, a text data of the selected song is loaded into the RAM 13 from the hard disc unit 23 to thereby start the performance program. At first, Step S21 is undertaken to initialize every part of the Karaoke system such as both of a bar number variable SN and a repeat flag RF are reset to "0". Then, Step S22 is undertaken to commence various regular processings such as automatic orchestra accompaniment. During the course of the accompaniment, Step S23 is undertaken to update the bar number variable SN everywhen the measure information containing the current bar number is read out from the RAM 13. Next, Step S24 is undertaken to check as to if the repeat switch 28 is actuated. If the repeat switch 28 is actuated, the repeat flag RF is set to "1" in Step S25. On the other hand, if the repeat switch 28 is not actuated, the processing advances to Step S26 while the repeat flag RF is held "0". In Step S26, check is made as to if the addressed text data contains the measure information, i.e., as to if the accompaniment comes to a border between adjacent measures. If the measure information is detected, Step S27 is undertaken to check as to if the repeat flag RF is set with "1". If RF="1" is held, Step S28 is executed to return to the same measure designated by the bar number held as SN to thereby effect the repeat operation as long as the repeat switch 28 stays actuated. Thereafter, Step S29 is undertaken to check as to if the accompaniment comes to a last end. If the check result is held NO, the processing returns to Step S22 to continue the operation until the last end of the accompaniment. On the other hand, when either check result of Steps S26 and S27 is held negative, the processing proceeds to Step S29. If the check result of Step S29 indicates the last end, the orchestra accompaniment is terminated.

Figure 6:
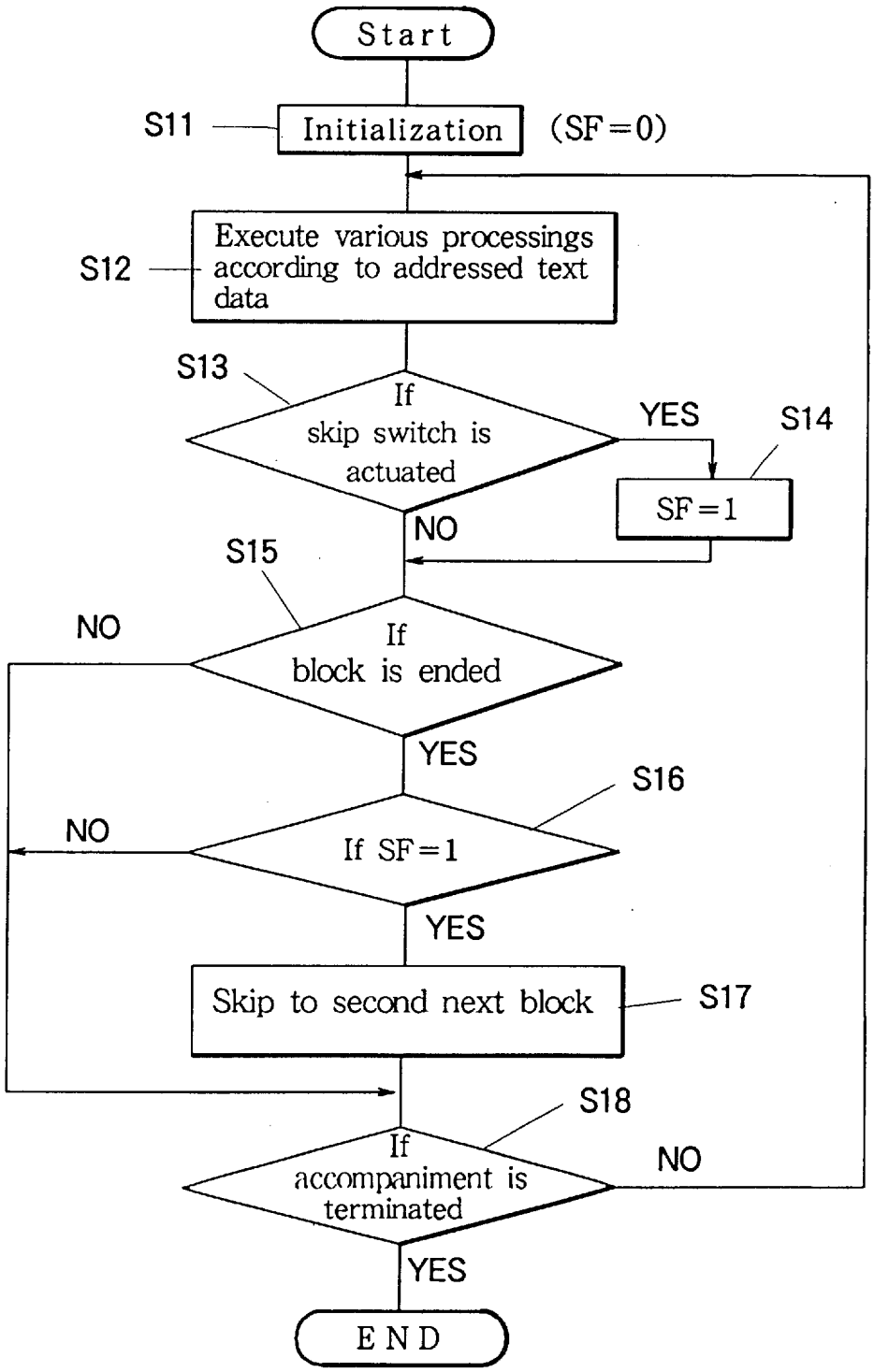
FIG. 6 is a flowchart showing skip operation in the FIG. 1 embodiment.

In the above descriptions the repeat operation is separately conducted from the skip operation shown in the FIG. 6 flowchart. However, practically the repeat and skip operations may be carried out in combination. Alternatively, either of repeat and skip functions may be eliminated according to size and capacity of the Karaoke system. As described above, in the first embodiment of the Karaoke apparatus, the performance data contains the accompaniment information and the picture information, those of which are recorded in the pair of parallel tracks TK1 and TK2, respectively, thereby enabling unusual performance such as skip or repeat performance in which the image on the display unit 22 can be linked to the skip or repeat of the orchestra accompaniment to thereby realize more interesting Karaoke song performance.

Figure 8:
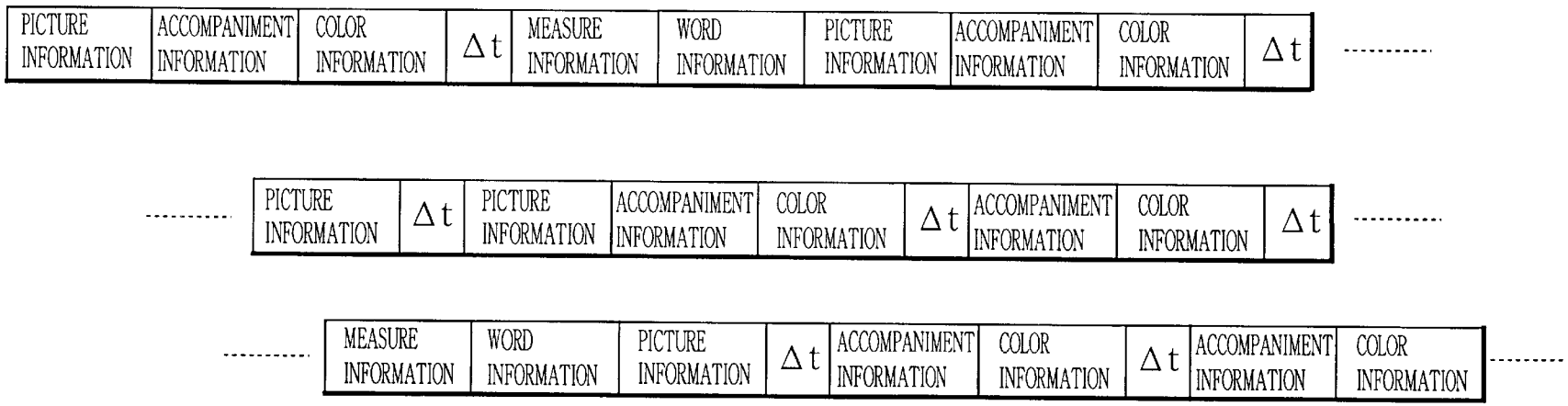
FIG. 8 is a format diagram illustrating an arrangement of performance data adopted in a second embodiment of the inventive Karaoke apparatus.

FIG. 8 shows another format of the performance data adopted in a second embodiment of the inventive Karaoke apparatus. In this embodiment, the text data of the Karaoke song containing the accompaniment information, picture information and else is recorded in a single track in serial manner such that the accompaniment information and the corresponding picture information are linked together in the same section while the time interval information is commonly shared, thereby enabling synchronized performance operation with reduced data amount. This embodiment has a system construction basically similar to the FIG. 1 embodiment. Namely, the text data of the selected song is transferred to the RAM 13 from the hard disc unit 23, and is sequentially read out for effecting the Karaoke performance. The text data contains an index data area at a top of the data format, which is similar to the FIG. 1 index data area.

This index data area is followed by performance data area as shown in FIG. 8, which is a main part of the text data. This performance data is composed of each section containing at least one of measure information, word information, picture information, accompaniment information and color information. Every section is separated from each other by interposed time interval information Δt. In this serial format, each section is arranged such that all the events associated to the measure information word information, picture information, accompaniment information and color information can occur concurrently. The second embodiment has the same system construction and the same operation manner as those of the first embodiment except for the data format and the data decoding. Therefore, the second embodiment is advantageous as compared to the first embodiment in that redundancy of the time interval information can be avoided to achieve efficient data compaction. Further, the accompaniment information and the picture information may not be linked together at every moment during the course of Karaoke performance, but may be linked together at significant moments.

In order to enrich the Karaoke performance, a play room of the Karaoke apparatus may be filled with a reverberation effect which simulates a famous concert hall or church. In such a modification, acoustic field information is registered in the same track as that of the accompaniment information or registered separately from the accompaniment information, together with the remaining word information, picture information and else. This acoustic field information contains acoustic field control parameters effective to operate all acoustic field controller provided in or around the Karaoke apparatus. Alternatively, the acoustic field information contains a select data for selecting desired acoustic field control parameters preset in the acoustic field controller. The acoustic field information is suitably arranged so as to realize a desired acoustic field in the play room to match with a mood of the performed Karaoke song to thereby enrich the Karaoke amusement. Such an acoustic field controller is disclosed in the U.S. Pat. No. 5,027,687. According to the invention, the acoustic field information is read out in synchronization with the accompaniment information, the word information and the picture information so as to control the acoustic field according to the selected song during the course of the Karaoke performance.

Occasionally, a singer bay be unfamiliar with a requested song. In another modification, the Karaoke apparatus in constructed to enable such a singer to listen to a model singing of the requested song before or after the Karaoke performance. In order to reproduce a model singing, primary melody information is registered in the same track as that of the accompaniment information or registered in a separate track on separate mediums such as Compact Disc or Laser Disc in linked manner to the accompaniment information, together with the remaining word and picture information. The primary melody information represents a model singing which is reproduced in the form of a melodious sound or a human voice, clearly discriminative form the background accompaniment. The model singing is selectively reproduced by command of the singer. The model singing operation call be efficiently combined to the skip or repeat operation according to the invention. For example, the singer listens to a part of the model singing, and then practices the song repeatedly after the model singing for lessen purpose. Otherwise, the singer practices the song, and then listens to the model singing for review. In the practicing, the accompaniment, the song word and the picture are repeatedly reproduced while the model singing may be suspended by command. The repeat or skip operation may be effected for a desired block of the song for intensive practicing. After or before the practicing, the singer can sing the song concurrently with the reproduction of the model singing to master the correct melody.

What is claimed is:

1. A Karaoke apparatus for reproducing an instrumental accompaniment of a requested song during the course of a vocal performance of the song by a singer, the apparatus comprising:

register means for registering composite data of a song containing synchronized accompaniment information, word information and picture information, wherein the accompaniment information, word information and picture information are synchronized with each other at a plurality of points during the song, said picture information corresponding to a plurality of images;

sound means receptive of the accompaniment information for reproducing an instrument accompaniment of said song according to the accompaniment information;

display means receptive of the word information and the picture information for displaying a word of said song in the form of a sequence of characters according to the word information, and for displaying, in superposed relation to the word, plural images associated with said song according to the picture information; and control means for addressing the composite data stored in the register means to sequentially distribute the synchronized accompaniment information, the word information and the picture information in synchronous manner with each other to those of the sound means and the display means so that the words of the song and said plural images can be displayed in a linked manner in accordance with progression of the sounded instrumental accompaniment.

2. A Karaoke apparatus according to claim 1, wherein the register means includes means for registering either of direct picture information which can be processed by the display means to directly form an image, and indirect picture information effective to designate a particular image stored in a storage means which is separate from the register means for processing by the display means.

3. A Karaoke apparatus according to claim 1, wherein the register means includes means defining a plurality of parallel tracks for recording respective ones of the accompaniment information, the word information and the picture information.

4. A Karaoke apparatus according to claim 1, wherein the register means includes means defining a serial track for recording serially the accompaniment information, the word information and the picture information.

5. A Karaoke apparatus for reproducing an instrumental accompaniment of a requested song during the course of a vocal performance of the song by a singer, the apparatus comprising:

register means for registering composite data of a song containing synchronized accompaniment information, word information and picture information, wherein the accompaniment information, word information and picture information are synchronized with each other at a plurality of points during the song;

sound means receptive of the accompaniment information for reproducing an instrument accompaniment of said song according to the accompaniment information;

display means receptive of the word information and the picture information for displaying a word of said song in the form of a sequence of characters according to the word information, and for displaying, in superposed relation to the word, an image associated to said song according to the picture information; and control means for addressing the composite data stored in the register means to sequentially distribute the synchronized accompaniment information, the word information and the picture information in synchronous manner with each other to those of the sound means and the display means so that the word and the image can be displayed in a linked manner in accordance with progression of the sounded instrumental accompaniment, wherein the control means includes skip means responsive to a given skip command for skipping distribution of the accompaniment information, the word information and the picture information concurrently with each other so that the displayed word and image can be skipped synchronously to skip of the sounded instrumental accompaniment.

6. A Karaoke apparatus for reproducing an instrumental accompaniment of a requested song during the course of a vocal performance of the song by a singer, the apparatus comprising:

register means for registering composite data of a song containing synchronized accompaniment information, word information and picture information, wherein the accompaniment information, word information and picture information are synchronized with each other at a plurality of points during the song;

sound means receptive of the accompaniment information for reproducing an instrument accompaniment of said song according to the accompaniment information;

display means receptive of the word information and the picture information for displaying a word of said song in the form of a sequence of characters according to the word information, and for displaying, in superposed relation to the word, an image associated to said song according to the picture information; and control means for addressing the composite data stored in the register means to sequentially distribute the synchronized accompaniment information, the word information and the picture information in synchronous manner with each other to those of the sound means and the display means so that the word and the image can be displayed in a linked manner in accordance with progression of the sounded instrumental accompaniment, wherein the control means includes repeat means responsive to a given repeat command for repeating distribution of the accompaniment information, the word information and the picture information concurrently with each other so that the displayed work and image can be repeated synchronously to repeat of the sounded instrumental accompaniment.

* * * * *